US007374408B2

(12) United States Patent
Savage et al.

(10) Patent No.: US 7,374,408 B2
(45) Date of Patent: May 20, 2008

(54) ENGINE COOLING FAN MOTOR WITH REDUCED WATER ENTRY PROTECTION

(75) Inventors: John R. Savage, Rochester Hills, MI (US); Sukeyuki Kobayaski, West Bloomfield, MI (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 524 days.

(21) Appl. No.: 10/744,677

(22) Filed: Dec. 22, 2003

(65) Prior Publication Data

US 2005/0135947 A1 Jun. 23, 2005

(51) Int. Cl.
*F04B 17/00* (2006.01)

(52) U.S. Cl. ..... 417/423.9; 417/366; 417/423.14

(58) Field of Classification Search ..... 417/423.7, 417/366, 368, 423.11, 423.9, 423.14; 310/58, 310/227, 88

See application file for complete search history.

(56) References Cited

U.S. PATENT DOCUMENTS

| | | | | |
|---|---|---|---|---|
| 2,550,443 | A * | 4/1951 | Bennett | 310/57 |
| 4,883,982 | A * | 11/1989 | Forbes et al. | 310/62 |
| 5,586,871 | A * | 12/1996 | Barnes et al. | 417/423.11 |
| 5,610,456 | A * | 3/1997 | Wille et al. | 310/58 |
| 5,929,544 | A * | 7/1999 | Maekawa et al. | 310/88 |
| 6,093,227 | A | 7/2000 | Benasutti | |
| 6,384,494 | B1 * | 5/2002 | Avidano et al. | 417/423.8 |
| 6,682,320 | B2 * | 1/2004 | Gold et al. | 417/368 |

* cited by examiner

*Primary Examiner*—Devon C. Kramer
*Assistant Examiner*—Peter J Bertheaud
(74) *Attorney, Agent, or Firm*—Young Basile

(57) ABSTRACT

An engine cooling fan motor has a water baffle positioned in a water line of sight passage through structures surrounding the motor to prevent water from impacting on the air vents at the front end of the motor. The baffle blocks the water line of sight passage. In one aspect, a rear cover is spaced from the rear endwall of the motor and has one or more baffled inlets to create an airflow passage to air inlet vents on the rear endwall of the motor.

24 Claims, 3 Drawing Sheets

ENGINE COOLING FAN MOTOR WITH REDUCED WATER ENTRY PROTECTION

BACKGROUND

The present invention relates, in general, to electric motors and, more specifically, to electric motors used in vehicle engine cooling fan assemblies.

Many vehicles use cooling fan assemblies driven by electric motors to provide cooling airflow for the radiator to control engine coolant temperatures and for the condenser which is part of the cabin air conditioning system. The cooling fan assembly and motor is typically located in the underhood environment immediately behind the radiator and condenser module. The underhood environment is very harsh with exposure to high temperatures, road debris, water spray and other environmental hazards. The engine cooling motor must operate in this harsh environment. Component temperatures inside the motor must be held below respective maximum levels to allow the motor to meet its performance and durability requirements. The motor must also survive exposure to water and other abuse factors and continue to operate in a normal manner.

The desire to control motor component temperatures and to enable the motor to survive in the harsh environment present conflicting design requirements. Motor component temperatures are often controlled by using elements in the fan hub to draw cooling airflow through the inside structure of motor itself The airflow removes heat from inside the motor and provides a means to control component temperatures.

A motor designed to allow cooling airflow to pass through the motor will also most likely allow entry of water and other contaminants that may damage the motor. Motor designs to limit water entry usually significantly reduce the volume of cooling airflow through the motor. Such designs typically provide constricted openings into the interior of the motor case. The small throat size of such openings impedes water entry while still providing a small amount of cooling airflow through the motor. Interior baffles or deflectors may also be mounted within the motor case across the small openings to limit the amount of water entry into the motor.

Designs to totally seal the motors against intrusion of both water and/or cooling airflow severely limit the power capability of the motor frame size thereby resulting in much lower wattage rated motors. Lower ratings can be increased through the use of more expensive higher temperature rated materials, insulation, winding and the like. And, for continuous operation, a suitable means or heat sink to carry heat away from the fan motor itself may be provided; but again, at a much higher cost.

Therefore, it has become a typical practice to provide air circulation apertures in the end bell or end wall of the drive motor case at a position closely adjacent to the fan blade hub. When water is sprayed up from the wheels or is entrained in the air, it may enter the motor through the ventilating openings. However, suitably positioned drain holes allow any water which may enter the motor to escape without collecting and presenting a potential for damage to the motor.

Thus, it would be desirable to provide a vehicle engine cooling fan drive motor having a design which incorporates ventilation opening but which prevents water entry into the motor. It would also be desirable to provide a vehicle engine cooling fan drive motor which, at the same time, provides enhanced cooling flow through the motor. It would also be desirable to provide a vehicle engine cooling fan drive motor which provides the above capabilities with minimal modification to existing motor designs. It would also be desirable to provide a vehicle engine cooling drive motor which provides the above capabilities while easily accommodating different motor blade and fan hub sizes and shapes.

SUMMARY

The present invention is water entry prevention means for preventing the intrusion of water into a ventilation aperture in a motor housing.

In one aspect of the invention, a motor vehicle engine cooling fan apparatus includes a fan having a fan hub supporting a plurality of fan blades, an electric motor having a motor shaft coupled to the hub for rotating the fan hub, the motor including a housing, a mounting bracket for supporting the motor housing in a motor vehicle, at least one ventilation aperture formed in the motor housing, and water entry prevention means for preventing entry of water into the at least one ventilation aperture.

In one aspect, the water entry prevention means is configured for preventing straight line intrusion of water between the motor housing and the motor mounting bracket into the at least one ventilation aperture. In this aspect, the at least one ventilation aperture in the housing opens between the motor housing and the fan hub.

The water entry prevention means may define a baffle carried on the motor housing and intercepting a straight line intrusion path of water between the motor housing and the motor mounting bracket into the at least one ventilation aperture. The baffle may be a plate having an end portion extending axially between the motor housing and the fan hub.

The baffle may alternately be a T-shaped member having a stem extending axially with respect to the motor output shaft and a cross-arm formed of a first arm portion extending radially toward the motor output shaft and a second arm portion extending radially toward the fan hub.

The baffle defines a channel with respect to the fan hub extending from the at least one ventilation aperture and along the fan hub.

In another aspect, the water entry prevention means includes a rear housing cover spaced from the rear wall of the housing to define an air flow path to at least one ventilation aperture in the rear wall of the housing. One or more inlets are formed in the rear housing cover.

In one aspect the motor housing has at least one mounting tab for mounting the motor housing to the motor mounting bracket. The inlet or inlets to the air flow passage are disposed below the portion of the motor mounting bracket which receives the motor mounting tab.

Baffle means may be provided for baffling air flow through the at least one inlet.

The present invention is a unique water entry prevention means for a vehicle cooling fan motor apparatus which blocks water entry and, more particularly, straight line water intrusion to at least the front portion of the motor housing containing one or more ventilation apertures through a gap between the outermost end of the fan hub and the adjacent motor mounting bracket. The formation of the water entry prevention means as a baffle carried on or otherwise disposed on the motor housing between the front portion of the motor housing and the adjacent fan hub blocks the straight line intrusion path of water to the front portion of the motor housing containing the ventilation apertures. In addition, the baffle can form a channel with the adjacent fan hub and hub ribs to funnel air flow from the ventilation apertures in the front of the motor outward toward the outer portion of the fan hub. This draws more cooling air and through the motor which enables the motor to run at lower operating temperatures at higher power ratings.

The provision of a air flow passage adjacent the rear wall of the motor housing containing one or more ventilation apertures also allows more cooling air to be drawn into the motor housing while restricting the entry of water into the ventilation apertures in the rear wall of the housing. The rear cover used to form the rear air flow passage may be unitarily formed with the motor mounting bracket. Air inlets to the air flow passage which are formed in the rear cover or motor mounting bracket may have surrounding baffles to restrict water entry.

The baffle forming the water entry prevention means of the present invention may be provided in different shapes and sizes to accommodate different fan hub/motor geometries.

BRIEF DESCRIPTION OF THE DRAWING

The various features, advantages and other uses of the present invention will become more apparent by referring to the following detailed description and drawing in which.

DETAILED DESCRIPTION

Figure 1:
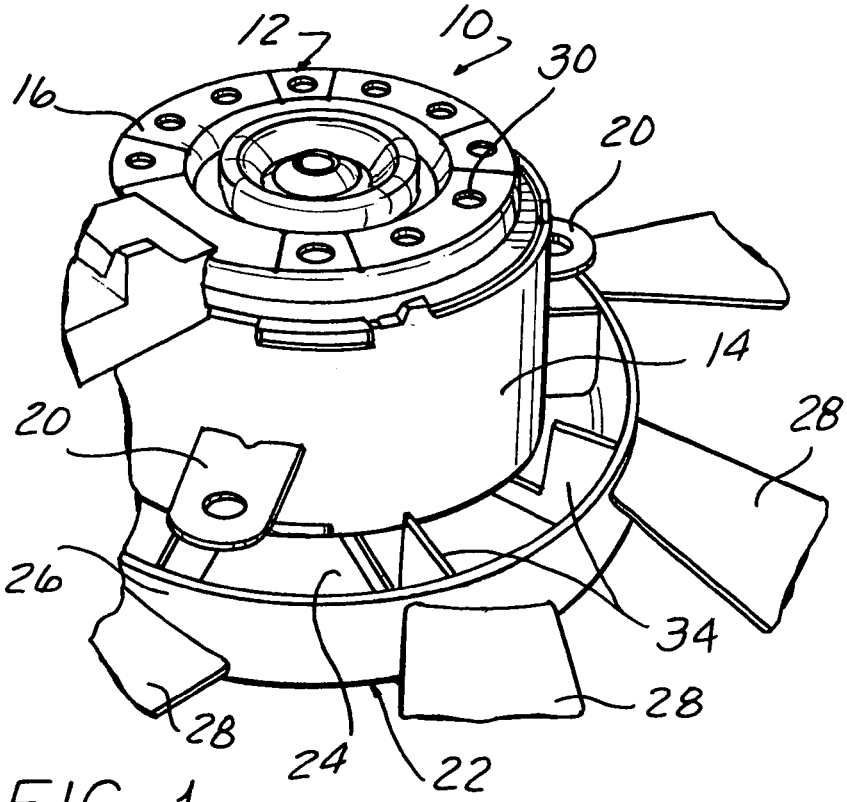
FIG. 1 PRIOR ART
FIG. 1 is a rear perspective view of a prior art engine cooling fan drive motor.

Refer now to the drawing there is depicted various aspects of a electric drive motor used as part of a cooling fan assembly to induce air flow through a vehicle radiator or condenser, not shown.

Figure 2:
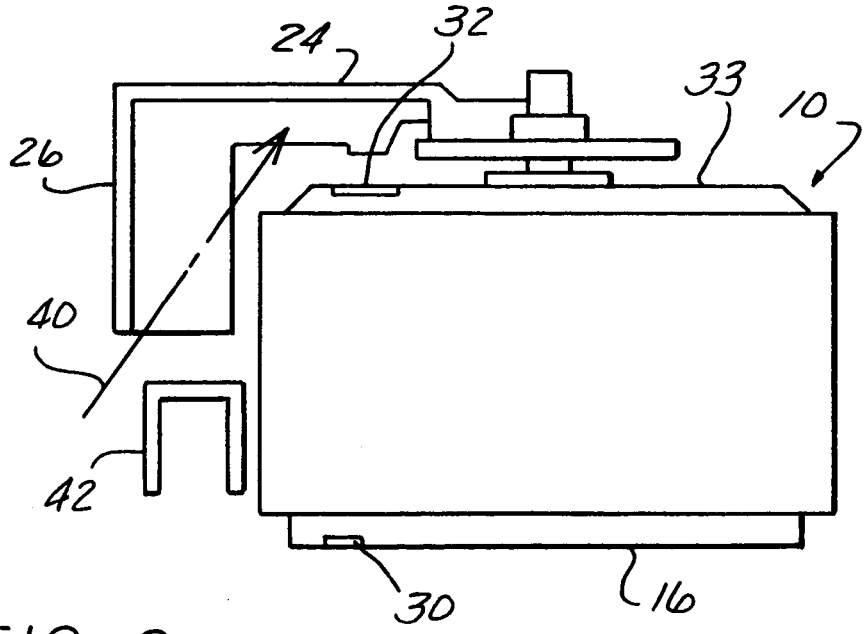
FIG. 2 PRIOR ART
FIG. 2 is a cross-sectional view of the fan and drive motor shown in FIG. 1.
Figure 3:
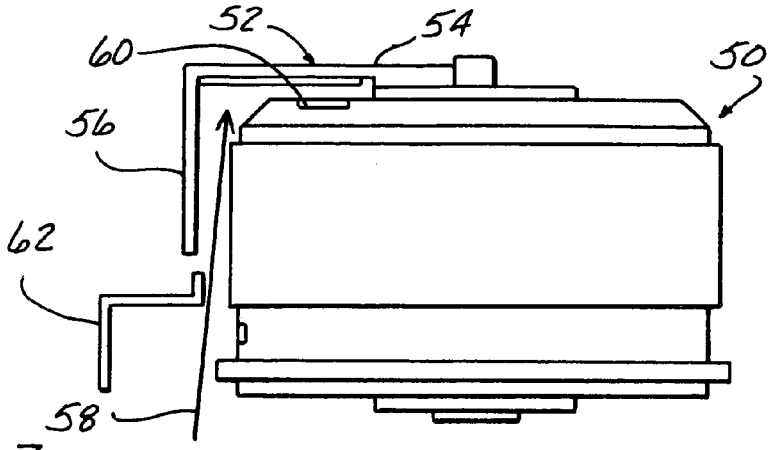
FIG. 3 PRIOR ART
FIG. 3 is a cross-sectional view of another prior art cooling fan and motor design.

For clarity and understanding the features and advantages of the present invention, a brief discussion of prior art engine cooling fan drive motors will be presented with reference to FIGS. 1-3.

In FIGS. 1 and 2, housing or one aspect of a prior art cooling fan drive motor 10, hereafter referred to simply as motor 10 depicts as including a case 12 with a sidewall 14 and a rear end bell or cap 16. A plurality of circumferentially spaced mounting tabs, all denoted by reference number 20, extend from the sidewall 14 of the motor case 12 and provide for mounting of the motor 10 to a motor support or mounting ring 42. The fan assembly 22 includes a hub 22 having a front wall 24 and a generally annular sidewall 26 extend radially outward from the outer edge of the front wall 24. Fan blades 28 extend from the sidewall 26.

As shown in FIG. 1, cooling air flow inlet vents 30 are provided on the rear end bell 12. Cooling air flow outlet ventilation apertures 32, see FIG. 2, are also provided on the front face of the motor housing.

Ribs or vanes 34 are provided in a radially extending manner on the rear surface of the front wall 24 of the hub 22. The ribs 34 provide support between the sidewall 26 and the front wall 24 of the hub 22 as well as acting as vanes to produce a suction force to draw air through the inlets 30 to the outlets 32 of the motor 10.

As shown in FIG. 2, a line of sight or straight line water entry path 40 exists between the motor mounting ring 42 and the front wall 33 of the motor 10 adjacent the air flow outlet vents 32 off of the back surface of the front wall 24 of the hub 22.

FIG. 3 depicts another type of prior art engine cooling fan motor design using a motor 50 with a fan hub 52 connected to a motor output shaft. The hub 52 includes a front wall 54 which transitions into an angular sidewall 56. The motor 50 and hub 52 design shown in FIG. 3 has a tighter clearance between the ID of the fan hub 52 and the OD of the motor housing 12. However, a direct line of sight path 58 to the front area of the motor 50 allows water access to air outlet vents 60 on the front of the motor through a gap between a motor support ring 62 and the motor housing. Although this is a much smaller pathway than in the motor/fan hub design shown in FIGS. 1 and 2, the motor 50 shown in FIG. 3 has a limited capacity to draw cooling air flow through the motor; but does maximize control of water entry to the front region of the motor 50.

Figure 4:
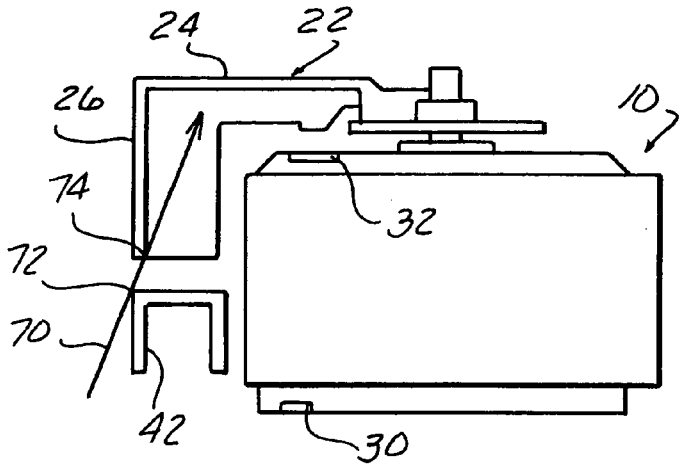
FIG. 4 PRIOR ART
FIGS. 4 and 5 are pictorial representations, each shown in cross-section, of a cooling fan drive motor with a water entry prevention means according to one aspect of the present invention.
Figure 5:
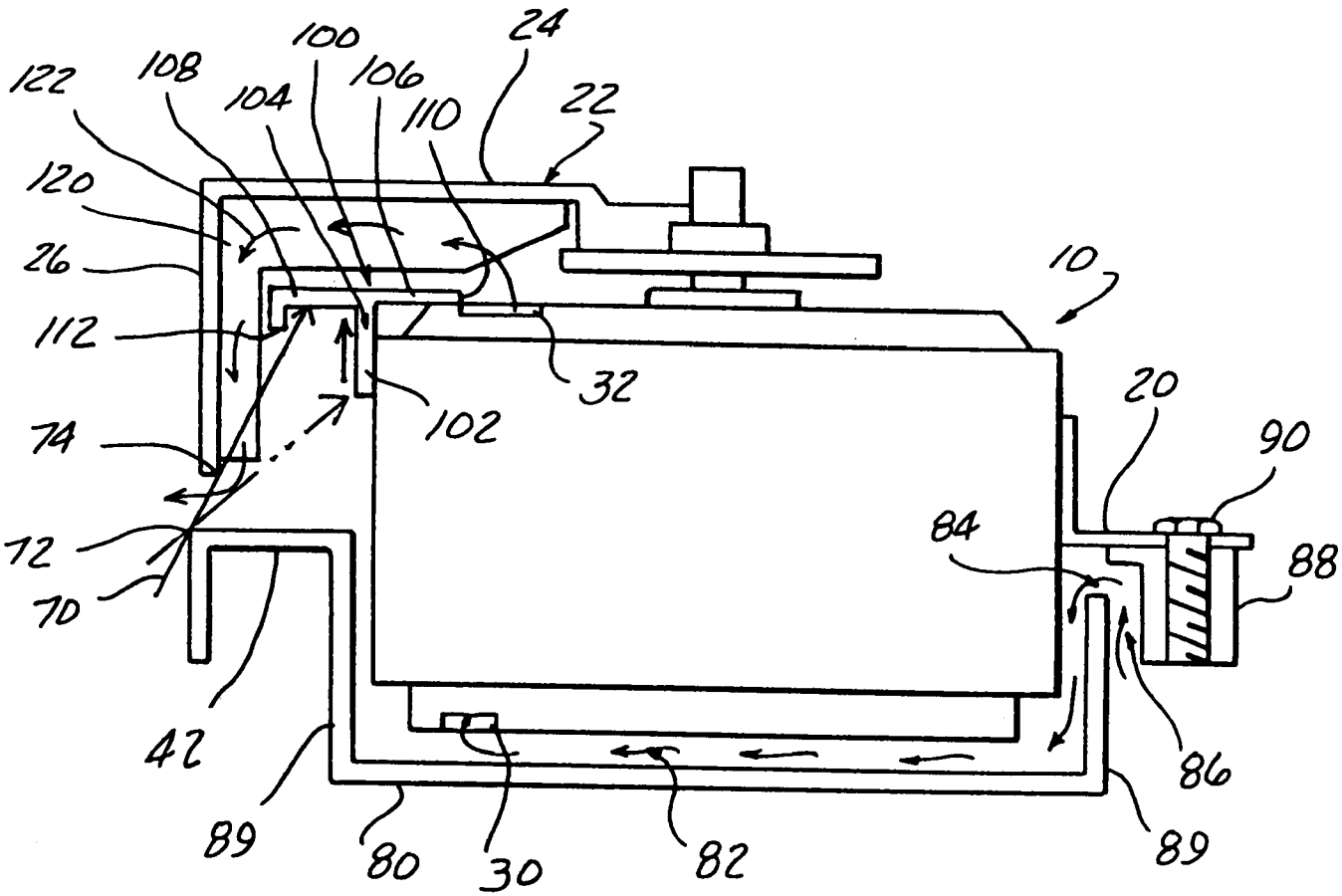

Referring now to FIGS. 4 and 5, there is depicted a water entry protection means 100 for the cooling fan motor 10 which maintains or improves the cooling air flow drawn through the motor 10; while, at the same time, restricts Water impingement on the air flow ventilation apertures 32 on the front wall of the motor 10. The water entry protection means is defined as a water baffle which blocks a straight line of sight water entry path 70 defined by the relationship of an outer forward corner 72 of the motor mounting or bracket ring 42 and the inner corner 74 or rear edge of the hub sidewall 26.

It should be noted that the hub 22 and the motor 10 described above and shown in FIG. 1 are employed by way of example only as a basis for using the water entry projection means or baffle 100 according to the present invention. The water entry protection means or baffle 100 can also be combined with a rear cover for the motor 10 so as to incorporate a baffled cooling air flow inlet strategy into the motor mounting structure.

Referring still to FIG. 4, the edge of the water entry protection means or baffle 100 must extend away from the motor 10 to at least meet the line of sight 70. Ideally, the water baffle 100 should extend beyond the line of sight 70 to better block water spray reflected from the motor housing.

It should be understood that the specific profile of the water baffle 100, shown in FIG. 5 is an example only. The relationship between a line of sight and the outer edge of the baffle 100 water entry. The actual profile of the baffle 100 can take many forms, one of which is shown in FIG. 5.

The water entry protection means 100 is designed as a water baffle having, by example only, a T-shaped cross-section. The baffle 100 is positioned on the forward corner of the motor housing 12 and can be a separate molded part of plastic or other suitable material that defines a 360° body of revolution with the cross-section shown in FIG. 5. The baffle 100 can be press or snap fit over the existing outer diameter of the motor case or otherwise attached to the motor case by adhesive, fasteners, etc. The baffle 100 can also be formed as a monolithic, integral part of the motor housing.

The baffle 100 includes by example as having a stem 102 and a crossbar 104 formed of a first arm 106 and a second arm 108. An inner edge 110 of the first arm 106 which defines the inner diameter of the baffle 100 preferably extends to meet the outer edge of the motor cooling air flow exhaust vent or vents 62.

The second arm 108 of the water baffle 100 extends to at least a diameter large enough to block the line of sight pathway 70 between the outside corner 72 of the motor mounting ring 42 and the edge 74 of the hub sidewall 26 at the rear or open end of the hub 22. An outer end 112 of the second arm 108 of the baffle 100 extends beyond the line of sight line 70 to increase the water blocking action. The outer edge 112 may be formed with an angular turned edge to block any additional water spray that may be reflected in a radial direction.

The stem 102 of the water baffle 100 not only assists in mounting the baffle 100 to the motor case, but also acts as a block to a reflected water spray path from water blocked by the inside surface of the second arm 108 of the baffle 100. Due to the high speed rotation of the fan hub 22, any water reflected by the baffle 100 is slung centrifugally outward away from the motor housing 12 through the gap between the edges 70 and 72.

By way of example, ribs 120 mounted in a circumferentially spaced manner about the inside surface of the front wall 24 and the sidewall 26 of the hub 22 have a profile closely following the outer surface of the baffle 100. The ribs 120 act as centrifugal fan blades to pull cooling air flow through the motor 10. Positioning the rear edge surface of the ribs 120 close to the outer surface of the water baffle 100 improves the air flow efficiency of the centrifugal fan action provided by the ribs 120. This clearance should be as small as possible limited by stack up of tolerance to avoid a strike or contact situation between the ribs 120 and the baffle 100.

Extension of the outer edge 110 of the first arm 106 of the baffle 100 to the outer edge of the cooling air flow exit vents 32 better focuses the pumping action of the centrifugal ribs 120 on the area of the vents 32 themselves. Further, the provision of the water baffle 100 forms a controlled cross-section passage between the airflow and the hub 22 leading to vents 32 on the motor 10 the gap between the edges 72 and 74 of the sidewall 26 of the hub 22 and the motor mounting ring 42. This increases the velocity of the air drawn out of the outlet vents 32 by the ribs 120 in the direction of arrow 122 in FIG. 5.

By way of example only, the outer diameter of the motor mounting support ring 42 can be increased to a minimum match the outer diameter of the fan hub 22. The outer diameter of the motor mounting ring 42 can be larger than the fan hub 22 diameter if desired. The increase in diameter reduces the line of sight access for water spray to the front wall 33 of the motor 10. The motor mounting ring 42 can be part of the plastic fan shroud and can be easily adapted to this dimensional specification.

As shown in FIG. 5, the rear motor cover 80 is added to the motor mounting ring 42 to prevent direct water spray from hitting the rear wall of the motor case and the cooling airflow inlet vents 30. The rear cover 80 could also be easily incorporated into the molded plastic shroud component.

It should be understood that the rear cover 80 is not required to work cooperatively with the front mounted water entry prevention means or baffle 100 to be effective. These are independent elements that work to separately control water access to the front and rear regions of the motor case.

Inlets 86 for cooling air flow are provided in the rear cover structure 80. The inlets 86 are located behind one, two or all of the mounting tabs 20 of the motor 10. Each tab 20 itself acts to close out the top portion of the water baffle area. The motor housing 12, walls and gaps in the plastic structure of the motor mounting support ring 42 act to form the water baffle feature as shown in FIG. 5.

The specific dimensions of the water baffle structure can be optimized to provide the best balance of water blockage and minimum restriction to the cooling airflow path 82 and 86. These baffled inlets 86 blow out cooling airflow to enter the gap 82 between the rear case 80 of the motor 10 and the plastic motor cover and that it be pulled into the cooling airflow inlet vents 30 on the rear endwall of the motor 10.

Any water that manages to pass through these baffle areas will have low velocity and will be guided primarily by gravity. This water will flow along the inside of the rear case cover 80 and will be guided primarily by gravity. This water will flow along the inside of the rear case cover 80 and will exit to a baffled drain in the bottom of the splashguard, not shown.

The same motor 10 and hub 22 are again depicted by way of example only. The motor mounting ring 42 is depicted as part of a rear motor cover 80 which extends between the annular ring portion 42 and is spaced from a rear surface of the motor 10 to define an air flow cooling path 82. One or more apertures 84 are formed in the rear cover 80 in a circumferentially spaced manner about the cover 80 to provide separate air passages or inlets 86 which access the air flow cooling passage 82 to provide an air flow stream to the air inlets 30 in the rear wall of the motor housing 22.

Also shown in FIG. 5 bosses 88 are formed at circumferentially spaced portions of the motor support ring 42 for receiving a motor mounting screw 90 which connects the mounting tabs 20 on the casing of the motor 10 to the motor support ring 42.

The bosses 88 are spaced from the wall 89 of the cover 80. The bosses 88 form the passage 86 with a labrynthian form extending to the inlet 84 which restricts water entry into the passages 82 and 86, while still allowing full air flow through the inlet 84.

Figure 6:
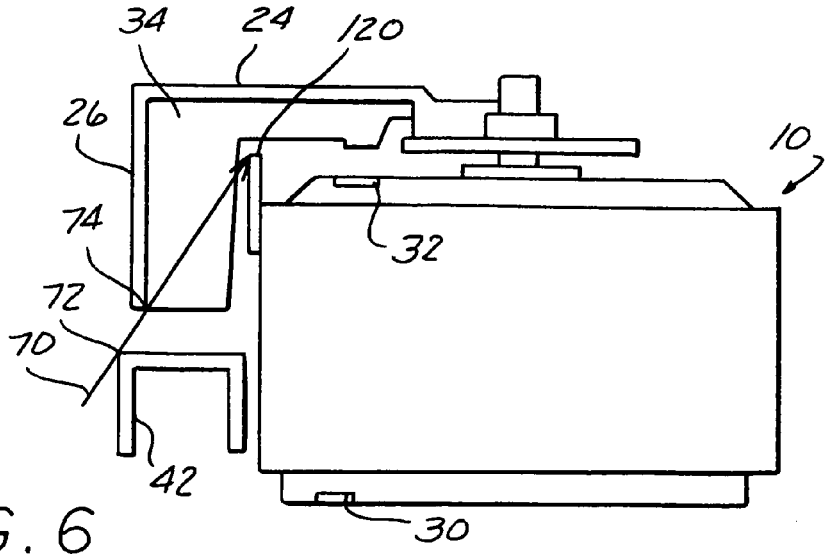
FIG. 6 is a pictorial representation, shown in cross-section, of a vehicle engine cooling drive motor with a water entry prevention means according to another aspect of the present invention.

Referring to FIG. 6, it is noted that the water baffle 100, described above and shown in FIG. 5, may not be required to have the above-described T-shaped cross-section. Another alternate aspect of a water baffle 120 is shown in FIG. 6 as having an axial shape in the form of an annular ring that extends forward from the front of the motor housing 12 to meet the line of sight 70 defined by the edges 72 and 74.

The baffle 120 is a separate member fixedly fasteners, adhesive or welding to the motor housing 12 or can be monolithically formed as part of the motor housing 12. This baffle configuration can be used with the existing fan hub ribs 34 without requiring modification to the ribs 34. The ribs 34 could then be optimized to further improve cooling air flow performance.

In conclusion, there has been disclosed a vehicle engine cooling fan motor assembly with a unique water baffle design to prevent the entry from water on the forward edge of a fan drive motor having air flow passages.

What is claimed is:

1. In a motor driven for a motor vehicle use including a motor with a housing and a motor shaft, a fan hub mounted on the motor shaft and including blades, a motor mounting bracket for supporting the motor, and at least one ventilating aperture in the motor housing, the improvement comprises:

water entry prevention means external of the motor housing for preventing entry of water into the at least one ventilation aperture wherein the water entry prevention means includes a baffle comprising a T-shaped member having a stem extending axially with respect to the motor output shaft and a cross-arm formed of a first arm extending radially toward the motor shaft and a second arm extending radially opposite toward the fan hub.

2. The improvement of claim 1 wherein:

an outer end of the second arm extends at an angle to the second arm.

3. The improvement of claim 2 wherein:

the cross-arm defines a channel in conjunction with the fan hub extending from the at least one ventilation aperture along the fan hub.

4. In a motor driven for motor vehicle use including a motor with a housing and a motor shaft, a fan hub mounted on the motor shaft and including blades, a motor mounting bracket for supporting the motor, and at least one ventilating aperture in the motor housing, the improvement comprising:

water entry prevention means external of the motor housing for preventing entry of water into the at least one ventilation aperture, the at least one ventilation aperture formed in a rear wall of the motor housing;

a plurality of mounting tabs formed on the motor housing; and a rear housing cover spaced from the rear wall of the housing to define an air flow passage to the at least one aperture in the rear wall of the housing, wherein at least one inlet is formed on the rear housing cover, wherein the improvement further comprises baffle means for baffling air flow through the at least one inlet, and a boss formed in the motor mounting bracket for receiving a fastener attaching one of motor housing mounting tab to the motor mounting bracket, the boss spaced from an adjacent portion of the rear housing to define a labyrinthian inlet path to the inlet and the air flow passage.

5. The improvement of claim 4 further comprising:

the at least one inlet to the air flow passage disposed in proximity with a portion of the motor mounting bracket which receives one of the motor housing mounting tab.

6. The improvement of claim 4 further comprising:

a plurality of spaced inlets formed on the rear housing cover.

7. The improvement of claim 4 further comprising:

the at least one inlet is a plurality of inlets to the air flow passage, one inlet disposed in proximity with one of the motor mounting tabs.

8. The improvement of claim 4 further comprising:

the rear cover unitarily formed with the motor mounting bracket.

9. A motor vehicle engine cooling fan apparatus comprising:

a fan having a fan hub supporting a plurality of fan blades; and an electric motor having a motor shaft coupled to the fan hub for rotating the fan hub, the motor including:

a housing;

mounting means for mounting the motor housing in a motor vehicle;

a first ventilation aperture formed in the motor housing for providing an inlet air vent and a second opposing ventilation aperture formed in the motor housing for providing an outlet air vent; and water entry prevention means external of the motor housing for preventing entry of water into the inlet and outlet vents, wherein the water entry prevention means includes a baffle, wherein the baffle includes a T-shaped member having a stem extending axially with respect to the motor output shaft and a cross-arm formed of a first arm extending radially toward the motor shaft and a second arm extending radially opposite toward the fan hub.

10. The apparatus of claim 9 wherein:

an outer end of the second arm extends at an angle to the second arm.

11. The apparatus of claim 10 wherein:

the cross-arm defines a channel in conjunction with the fan hub extending from the at least one of the first and second ventilation aperture along the fan hub.

12. A motor vehicle engine cooling fan apparatus comprising:

a fan having a fan hub supporting a plurality of fan blades; and an electric motor having a motor shaft coupled to the fan hub for rotating the fan hub, the motor including:

a housing;

mounting means for mounting the motor housing in a motor vehicle;

a first ventilation aperture formed in the motor housing for providing an inlet air vent and a second opposing ventilation aperture formed in the motor housing for providing an outlet air vent;

water entry prevention means external of the motor housing for preventing entry of water into the inlet and outlet vents;

a rear housing cover spaced from a rear wall of the motor housing to define an air flow passage to the at least one ventilation aperture formed in the rear wall of the motor housing, and at least one inlet formed in the rear housing cover; and baffle means for baffling air flow through the at least one inlet, wherein the baffle means includes a boss formed in the motor mounting means for receiving a fastener attaching a motor housing mounting tab to the motor mounting means, the boss spaced from an adjacent portion of the rear housing cover to define a labyrinthian inlet path to the inlet and the air flow passage.

13. The apparatus of claim 12 wherein:

the water entry prevention means defines means for preventing straight line intrusion of water between the motor housing and the motor mounting means into at least one of the first and second ventilation aperture.

14. The apparatus of claim 12 wherein:

the water entry prevention means comprises:

a baffle.

15. The apparatus of claim 14 wherein the baffle comprises:

a plate having an end portion extending axially between the motor housing and the fan hub.

16. The apparatus of claim 14 wherein:

the baffle defines a channel with the fan hub extending from the at least one of the first and second ventilation aperture along the fan hub.

17. The apparatus of claim 16 wherein:

the channel extends to an opening between one end of the fan hub and the motor mounting bracket.

18. The apparatus of claim 14 wherein:

the baffle is carried on the motor housing.

19. The apparatus of claim 18 wherein:

the baffle is press fit on the motor housing.

20. The apparatus of claim 14 wherein:

the baffle is disposed between the motor housing and ribs carried on an inside surface of the fan hub.

21. The apparatus of claim 12 further comprising:

the motor housing having at least one mounting tab for mounting the motor housing to the motor mounting means; and the at least one inlet to the air flow passage disposed in proximity with a portion of the motor mounting means which receives the motor mounting tab.

22. The improvement apparatus of claim 12 further comprising:

a plurality of spaced inlets formed on the rear housing cover.

23. The improvement apparatus of claim 12 further comprising:

a plurality of mounting tabs formed on the motor housing; and the at least one inlet is a plurality of inlets to the air flow passage, one inlet disposed in proximity with one of the motor mounting tabs.

24. The apparatus of claim 12 further comprising:

the rear cover unitarily formed with the motor mounting means.

* * * * *

UNITED STATES PATENT AND TRADEMARK OFFICE

CERTIFICATE OF CORRECTION

PATENT NO. : 7,374,408 B2
APPLICATION NO. : 10/744677
DATED : May 20, 2008
INVENTOR(S) : Savage et al.

It is certified that error appears in the above-identified patent and that said Letters Patent is hereby corrected as shown below:

| | |
|---|---|
| Title page - Column 1, Line 2 (Inventors) | Replace “Kobayaski” with --Kobayashi--. |
| Column 1, Line 29: | After “itself” insert --.--. |
| Column 4, Line 27: | Replace “Water” with --water--. |
| Column 9, Line 1 (Claim 22): | After “The” delete “improvement”. |
| Column 9, Line 5 (Claim 23): | After “The” delete “improvement”. |

Signed and Sealed this

Second Day of December, 2008

JON W. DUDAS
*Director of the United States Patent and Trademark Office*